US006276858B1

(12) United States Patent
Kennedy

(10) Patent No.: US 6,276,858 B1
(45) Date of Patent: Aug. 21, 2001

(54) RESIN APPLICATOR

(76) Inventor: Matthew Gordon Charles Kennedy, 3-4165 Rue de L'Esplanade, Montréal, QC (CA), H2W 159

( * ) Notice: Subject to any disclaimer, the term of this patent is extended or adjusted under 35 U.S.C. 154(b) by 0 days.

(21) Appl. No.: 09/601,223

(22) PCT Filed: Nov. 29, 1999

(86) PCT No.: PCT/CA99/01124

§ 371 Date: Jul. 28, 2000

§ 102(e) Date: Jul. 28, 2000

(87) PCT Pub. No.: WO00/35592

PCT Pub. Date: Jun. 22, 2000

(51) Int. Cl.[7] ..... B43K 29/00

(52) U.S. Cl. ..... 401/193; 401/48; 401/266; 401/265

(58) Field of Search ..... 401/266, 265, 401/261, 14, 48, 137, 193

(56) References Cited

U.S. PATENT DOCUMENTS 2,930,061 * 3/1960 O'Neil ..... 401/193
3,334,792 * 8/1967 De Vries et al. ..... 401/193

FOREIGN PATENT DOCUMENTS

607657 * 9/1948 (GB) ..... 401/193
1371662 * 10/1974 (GB) ..... 401/193

* cited by examiner

*Primary Examiner*—David J. Walczak

(57) ABSTRACT

The invention is an applicator and process used to fill in the edges of composite panels with resin or emulsions. The applicator is attached to a source of resin that forces the resin through the applicator's delivery channel, into a space between the applicator's spatula and the panel's edge. The sidewalls of the applicator guide the applicator along the edge of the panel as it is drawn along to fill the edge and also to prevent spill over. The underside of the main body of the applicator aft of the delivery channel is a spatula that tapers toward the panel's edge and acts to smooth the resin into and flush with the panel's sidewalls. A finger guide allows the applicator to work using finger pressure. The applicator is drawn along with the hands, and where the leading edge of the applicator body rests on the panel there is a rounded lip to allow the applicator to traverse smoothly over roughness and imperfections on the panel's edge. The rounded lip feature also functions as a pivot that allows the applicator to be pivoted in such a way that the sidewalls will rise above the panel's edge so that the applicator can clear obstacles like adjoining panels without having to be removed from the panel being filled. Ribs on the underside of the spatula facilitate the flow of resin over the entire edge of the panel. The applicator may be fashioned to accommodate varying panel thickness or edge profile, such as straight, angled, or bullnosed. The applicator may also be used to apply adhesives to the edges of solid panels. The invention can alternatively be fashioned for automation.

9 Claims, 2 Drawing Sheets

RESIN APPLICATOR

This invention and process relates to a pressure aided resin application device for applying resins into the open cell edges of composite panels or onto the edges of solid panels. Resins may be defined alternatively as emulsions, fluids, adhesives, glues, mucilage, cements, and epoxies.

BACKGROUND OF THE INVENTION

The resin applicator and the process mentioned herein was designed to make the production of composite panel cabinetry more efficient and less costly by allowing workers to work more quickly than conventional methods. Since composite panels (like No-mex® and Fiberlam®) have open cells at their edges, these edges must be filled with materials (such as the Epocast® emulsion) to strengthen the brittle edges and provide a stabilizer for joinery screws and nuts and a surface for veneering.

This procedure, called edgefilling, is conventionally preformed by hand with a spatula that crudely spreads the emulsion or resin into the open-celled edges of composite panels. This procedure cannot guarantee an even fill density and it leaves a lot of extra residue on the panels, which is wasteful and inefficient. Once the residue dries, the worker must sand the material flush with the edges of the composite panel.

The resin applicator is an efficient tool for edge-filling composite panels. The applicator would typically be made of injection molded plastic, with any textures on the surface to be facilitated in the mold. The applicator is to be used in conjunction with a pressurized source of resin such as a cartridge filled with the resin wherein the resin is forced through the applicator through a pressure delivery system like a trigger activated caulking gun or air-pressure gun. The process involves injecting resin into a panel's edge through the applicator as it is drawn along the panel's edge. As the applicator applies the resin, it forces resin into the open cells at the panel's edge and automatically spreads this material flush with the panel's edges since the extended posterior of the applicator functions as a spatula. It therefore completes the spreading and smoothing operations with one simple procedure, which considerably reduces worker-hours and material waste. The finish is even, and requires little or no sanding.

The smoothing function of the applicator is dependent on hand pressure from the worker, applied in a finger guide on the top surface of the applicator's spatula feature. The rate at which the material is dispersed is dependent upon the air pressure and valve size of the gun, as well as the rate at which the worker draws the applicator along the panel. In an automated scenario the panel would be drawn through the invention, supported by a fixed structure and pressure delivery system, either manually or by automated means, such as a conveyor system. By this method, hand-pressure would be replaced by machine pressure. Either application of the invention improves the process of edge-filling over conventional methods.

The invention has sidewalls extending downwards from the spatula feature that forms a channel through which the panel is passed during the application procedure. The sidewalls stabilize the device during the application process. The width of the channel between the sidewalls is to be the same width as the panel being filled, plus tolerances. Therefore the invention may be fashioned with varying sidewall gap widths to accommodate different thickness of panel. The sidewalls function as a guide to prevent lateral movement of the applicator, so that the applicator will not fall off the panel during the process. Typically, the invention will be fashioned so that the sidewalls of the applicator will be parallel to each other and to the sidewalls of the panel it is applied to. The leading edges of the sidewalls are also flanged outward slightly so that the applicator may be easily slipped onto a panel since the flanges help center the panel between the sidewalls.

The invention has features in its design to overcome rough surfaces on the panel's edge, and obstacles attached to the sides of the panel. There is a rounded lip at the leading edge of the applicator body where it rests on the panel and situated anterior to the delivery point that allows the resin applicator to overcome any nicks, snags, or rough surfaces on the edge of the panel as it is drawn along thereby facilitating a controlled pace which is important for an even flow of resin into the panel's edge.

The rounded lip acts as a pivot as well. This pivot is aligned with an axis perpendicular to the sidewalls of the applicator. The pivot axis is situated between the forward plane of the delivery channel and the leading edge of the sidewalls. The angle between the forward plane of the delivery channel and the leading edge of the sidewalls is 180 degrees or greater. This allows the leading edges of the applicator's sidewalls to rise above the edge of the panel being filled when the user pivots the applicator at the rounded lip by lowering the top attachment-end of the delivery channel toward the panel's edge. This feature is important when there is an obstacle attached to the side of the panel, such as another panel, since the user of the resin applicator can pass the obstacle by leaning the applicator back and therefore will not have to remove the applicator from the panel being filled. When this feature is used, every part of the resin applicator will be above the edge of the panel being filled therefore any obstacle below the edge of the panel will not block the progress of the applicator. The applicator is then slid along the panel's edge and once the obstacle has been passed the user of the applicator may then lower the sidewalls and continue filling the panel as before.

The applicator may be fashioned to accommodate panel edge profiles of varying shape. Typically the edge of the panel will be perpendicular to its sidewalls, however the edge may be at another angle as in the case of a beveled edge. The edge may also take a contoured shape, such as a bullnose. The spatula of the resin applicator may be fashioned to accommodate these shapes. The pivoting feature of the invention, however, functions only when the plane of the pivoting axis is perpendicular to the sidewalls of the applicator.

BRIEF DESCRIPTION OF THE DRAWINGS

In the drawings that illustrate an embodiment of the invention.

DETAILED DESCRIPTION OF THE PREFERRED EMBODIMENT

Figure 1:
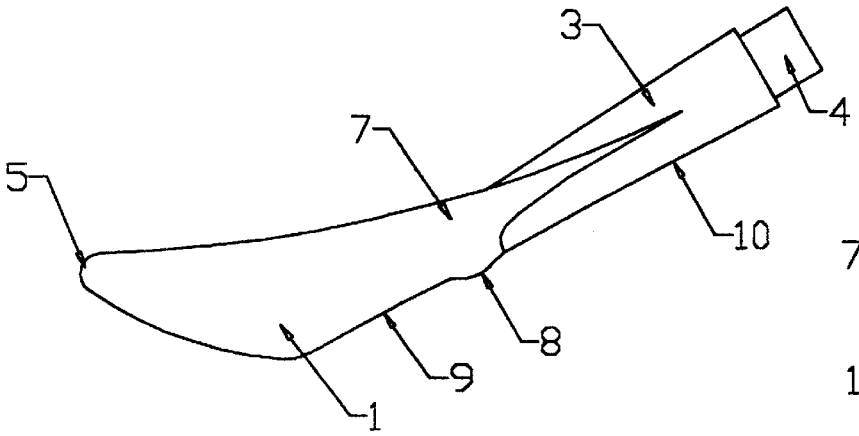
FIG. 1 is a side view of the embodiment.
Figure 2:
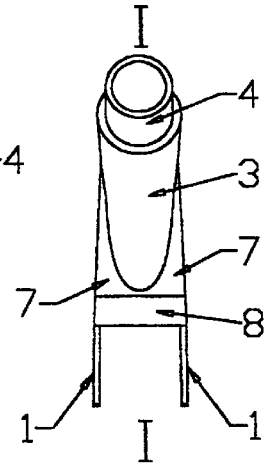
FIG. 2 is a front view of this embodiment.
Figure 3:
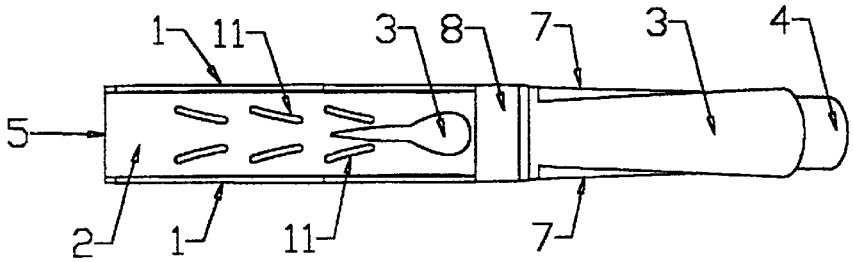
FIG. 3 is a bottom view of the embodiment.

The tool illustrated is comprised of sidewalls 1 that act as horizontal stabilizers and guides that prevent the tool from slipping off the panel, or allowing the resin to spill over the edges of the panel. The sidewalls 1 descend from the bottom portion of the applicator body so that they contain within a channel the delivery point 12 at the lower opening of the delivery channel 3 and the spatula 2, which forms the lower surface of the invention posterior to the delivery point 12. The leading edges 9 of the sidewalls 1 are flanged outward so that they facilitate the entry of a panel into the channel between the sidewalls 1. The resin is forced through the delivery channel 3 and delivery point 12 into the panel's edge that passes through the channel between the sidewalls 1 from the pressure injection device (not depicted) used, which is attached by necessary joining means to the attachment-end 4 of the delivery channel 3. The transition between the delivery channel 3 and the spatula 2 at the delivery point 12 is a gradual curve, and the spatula 2 itself tapers from the delivery point 12 downward toward the aft-end 5 where the applicator would rest on the panel being edge-filled. The curve between the delivery channel 3 and the spatula 2 and the taper angle on the spatula 2 facilitate a smooth flow during the transition of resin from the delivery channel 3 to the area underneath the spatula 2. The taper on the spatula 2 also allows the resin to be smoothed into the panel's edge steadily and gradually during the edge-filling process, providing the invention to apply resin fill at an even and consistent rate. Pressure applied by the user's finger in the finger guide 6 keeps the applicator against the panel's edge and prevents excess resin from coming out of the aft-end 5 of the applicator.

Figure 4:
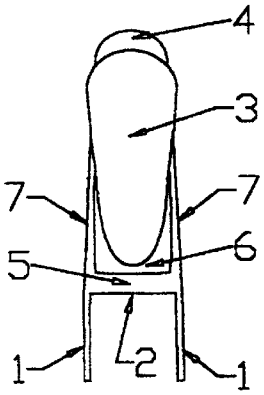
FIG. 4 is a back view of the embodiment.
Figure 5:
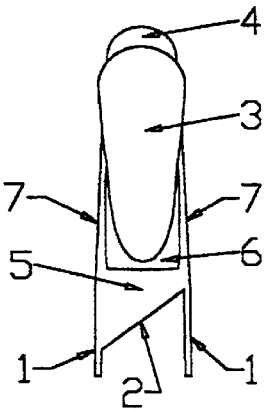
FIG. 5 is a back view of another embodiment with an angled spatula.
Figure 6:
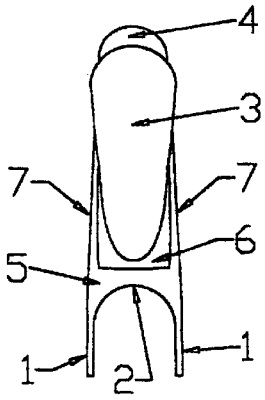
FIG. 6 is a back view of another embodiment with a rounded spatula.
Figure 7:
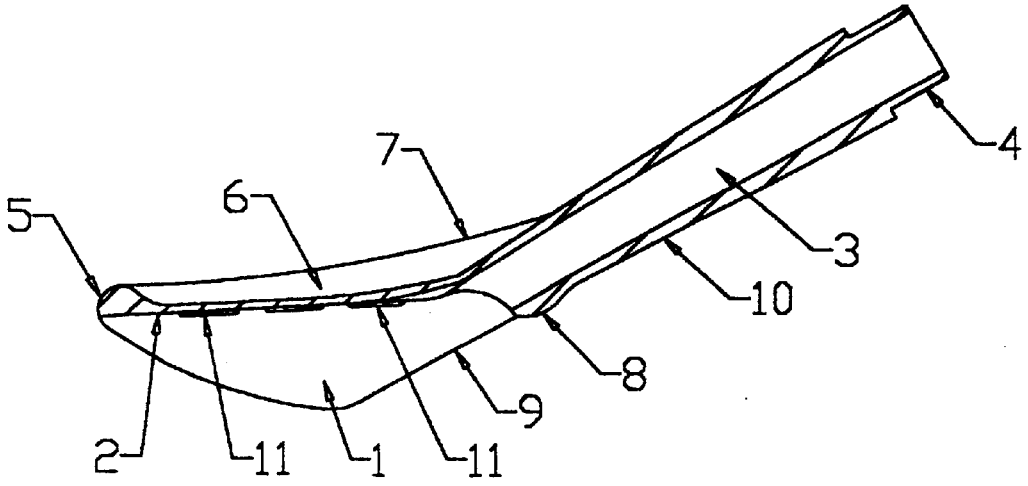
FIG. 7 is a section of line I—I of FIG. 2.

The applicator may be fashioned with varying angles between the spatula 2 and the sidewalls 1 to facilitate edge-filling panels with angled edges, or the spatula 2 may have a contoured profile, such as to accommodate a bullnose. Typically the spatula 2 will be perpendicular to the sidewalls 1, with allowances for draft angles, as seen in the embodiment shown in FIG. 4. In the embodiment shown in FIG. 5 the spatula 2 is not perpendicular to the sidewalls 1 but is on an alternative angle. In the embodiment shown in FIG. 6 the spatula 2 has a circular shape to accommodate a bullnose shape on the panel's edge.

The invention features two cantilevers 7 rising from the spatula 2, bridging the spatula 2 and the delivery channel 3 thereby strengthening and stiffening the applicator. The space between these cantilevers 7 form the finger guide 6 that allows the user of the applicator to control the device with precision as it is used. The finger guide 6 is shaped to allow a finger between the walls of the cantilevers 7, with suitable slopes fore and aft to prevent the finger from slipping out. The finger guide 6 also benefits from having a textured surface to provide better gripping for the finger.

The leading edge of the applicator body where it will come to rest on the panel features a rounded lip 8. A sharp edge at the leading edge of the applicator body would cause the applicator to snag on rough surfaces on the panel's edge. The rounded lip 8 allows the resin applicator to overcome any nicks, snags, bumps, or imperfections rough surfaces on the edge of the panel as it is drawn along thereby facilitating a controlled pace which is important for an even flow of resin into the panel's edge.

In FIG. 1, the angle between the leading edges 9 of the sidewalls 1 and the forward plane 10 of the delivery channel 3 is 180 degrees or more. This insures that when the attachment-end 4 of the resin applicator is pivoted at the rounded lip 8 downward toward the panel being filled, the sidewalls 1 will rise accordingly and clear the top edge of the panel. The delivery channel 3 can be fashioned at any angle in relation to the spatula 2, however the angle between the centerlines of the delivery channel 3 and the spatula 2 will typically be 150 degrees for ergonomic reasons. This angle allows the user to manipulate the device comfortably while allowing the user to observe the results of edge-filling at the aft-end 5.

Figure 8:
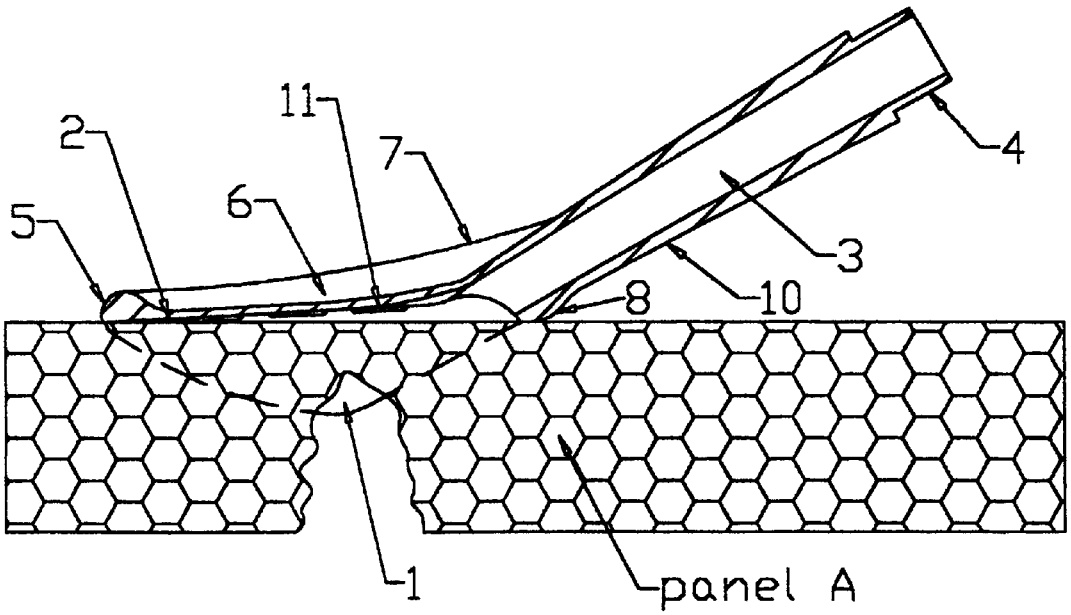
FIG. 8 shows the same view as FIG. 7 but showing the embodiment resting on panel A.

The delivery point 12 in some design variations of the resin applicator may be smaller than the width between the sidewalls 1. Shallow ribs 11, located under the spatula 2 of the invention, are shaped to direct the flow of some resin toward the sidewalls 1 and therefore toward the sidewalls of the edge of the panel being filled. In the embodiment shown in FIG. 8, the resin moves from the delivery channel 3 into the fill-area between the spatula 2, the sidewalls 1, and the edge of the panel A being filled. The pressure of the resin entering this space from the delivery system is sufficient to insure that the entire width of the panel's edge will be evenly filled, as the pressure will cause the resin to spread into any available space.

The embodiments of the invention in which an exclusive property or privilege is claimed are defined as follows:

1. An applicator comprising:

an applicator body connectable by joining means to a pressurized source of resin for the application thereof into open-cells at the edges of composite panels or onto the edges of solid panels, a delivery channel extending through said applicator body to an applicator delivery point on a bottom portion of the body whereby the resin travels from said pressurized source to said delivery point, a spatula means generally flush to a panel's edge and situated posterior to said delivery point whereby the resin is smoothed into said open-cells and generally flush to said edge as the applicator is drawn across said panel by a user in the case of a composite panel, or in the case of a solid panel the spatula means permits the resin to be delivered onto said edge applicator sidewalls extending from said bottom portion of said applicator body and thereby forming a channel area along a portion of the length of the body's bottom portion adapted to guide the applicator along said panel's edges, and a rounded lip at said bottom portion of the applicator body and situated anterior to said delivery point adapted to enable the applicator to traverse panel edge bumps and imperfections and functions as a pivot to enable the applicator to tilt forward, raising the applicator's sidewalls above the edge of said panel to clear obstacles attached to the sides of said panel.

2. An applicator as defined in claim 1, wherein the applicator's sidewalls are parallel to each other and to walls of a panel the applicator is used on, to permit the applicator to be laterally stabilized to said panel and to provide a tight fit so as to prevent resin spill over between said sidewalls of the applicator and said walls of said panel.

3. An applicator as defined in claim 1 or 2, wherein leading edges of the applicator's sidewalls are flanged outward so that they allow the applicator to center a panel between said sidewalls as the applicator is first put on said panel to prevent said leading edges of said sidewalls from snagging on the edges of said panel.

4. An applicator as defined in claim 1 or 2, wherein said spatula means includes a plurality of ribs adjacent to said delivery point to facilitate resin delivery into and over the entire edge of a panel by directing the resin thereto.

5. An applicator as defined in claim 1 or 2, wherein said spatula means is generally perpendicular to said applicator sidewalls, at an angle to said sidewalls other than perpendicular, or rounded.

6. An applicator as defined in claim 1 or 2, wherein a finger guide at a top portion of the applicator body is disposed to allow a user to apply pressure to the applicator and said spatula and have a steady hold of the applicator through its operations.

7. An applicator as defined in claim 1 or 2 wherein an angle between a forward plane of the delivery channel and leading edges of said applicator sidewalls is 180 degrees or more to allow said sidewalls to rise above an edge of a panel when said delivery channedl is pivoted downward by means of sid rounded lip.

8. An applicator as defined in claim 1 or 2 wherein an angle between said spatula means and said delivery channel is about 150 degrees to allow a comfortable posture for a use and allow said user a view of a posterior end of the applicator where said spatula means is smoothing the resin into or onto a panel's edge.

9. An applicator as defined in claim 1 or 2 wherein the applicator is adapted for manual or automated use.

* * * * *